United States Patent [19]

Moser et al.

[11] 4,053,147

[45] Oct. 11, 1977

[54] DEVICE FOR INTRODUCTION OF GASES INTO REACTION VESSELS CONTAINING FLUIDS

[75] Inventors: Robert Moser, Steg; Alfred Steinegger, Venthone; Fritz Dolder, Wallisellen; Horst Feddern, Schaffhausen, all of Switzerland

[73] Assignee: Swiss Aluminium Ltd., Chippis, Switzerland

[21] Appl. No.: 649,137

[22] Filed: Jan. 14, 1976

[30] Foreign Application Priority Data

Apr. 24, 1975 Switzerland ..... 5289/75

[51] Int. Cl.[2] ..... C21C 5/48

[52] U.S. Cl. ..... 266/220

[58] Field of Search ..... 266/220, 265, 268, 222; 82/33 R

[56] References Cited

U.S. PATENT DOCUMENTS

| | | | |
|---|---|---|---|
| 2,811,346 | 10/1957 | Spire | 266/220 |
| 2,871,008 | 1/1959 | Spire | 266/220 |
| 2,947,527 | 8/1960 | Spire | 266/220 |
| 3,334,531 | 8/1967 | Fischer | 82/33 R |
| 3,343,829 | 9/1967 | Coates | 266/220 |
| 3,541,604 | 11/1970 | Nomura et al. | 266/220 |
| 3,829,073 | 8/1974 | Courard | 266/268 |
| 3,834,685 | 9/1974 | Ziemkiewicz et al. | 266/220 |

FOREIGN PATENT DOCUMENTS

| | | | |
|---|---|---|---|
| 590,537 | 1/1960 | Canada | 266/220 |
| 2,105,961 | 8/1972 | Germany | 266/220 |
| 697,915 | 10/1950 | United Kingdom | 266/220 |
| 1,037,158 | 7/1966 | United Kingdom | 82/33 R |
| 250,962 | 2/1970 | U.S.S.R. | 266/220 |

*Primary Examiner*—Gerald A. Dost
*Attorney, Agent, or Firm*—Ernest F. Marmorek

[57] ABSTRACT

A vessel which, when in use, is subject to thermal stress, and which includes a device for introduction of gas through the wall of the vessel, the device comprising a metal sleeve fastened to the outer face of the wall of the vessel in an adjustable and easily exchangeable manner by a combination of screws and spring washers, and a gas-permeable body of fire-resistant material which is mounted adjustably and exchangeably in the metal sleeve under spring pressure. Either a major portion of the gas-permeable body is formed as a frustum of a cone, which has a short cylindrical portion on its end of larger cross section, or the gas-permeable body consists of two cylindrical portions of different cross section. The spring pressure is exerted by at least one dished spring column consisting of a series of pairs of oppositely oriented dished spring washers.

2 Claims, 6 Drawing Figures

DEVICE FOR INTRODUCTION OF GASES INTO REACTION VESSELS CONTAINING FLUIDS

The invention relates to devices for introduction of gases into vessels which contain fluids and are subject to thermal stress, by means of a gas-permeable body of fire-resistant material which is mounted in a metal sleeve, which itself is fastened to the wall of the vessel. One kind of vessel to which the invention is applicable is housings of filters for handling metal melts.

In methods of treatment of metal melts in which gases are continuously introduced into the melt, gas-permeable bodies (inlet bricks) of fire-resistant material are employed in gas inlet devices. It has hitherto been difficult for these bricks to be secured so as to be easily exchangeable, and nevertheless be tight in the wall of the vessel. Attempts have previously been made to build the gas-permeable bodies permanently into the wall of the vessel, consisting of concrete or similar material. This has the significant disadvantage that, for periodical necessary exchange of the gas-permeable bodies, the relevant wall of the vessel must be totally destroyed, which brings with it significant costs, loss of time, and reduced working life of the vessel. A further disadvantage of this arrangement lies in the fact that a tight connection between gas inlet bricks and the wall of the vessel cannot in fact be attained, because the different thermal coefficients of expansion of the materials employed for gas inlet bricks, bonding means, and wall, lead easily to gaps at the point of connection upon heating up of the vessel by the metal melt. This has the consequence that the gas under pressure may escape through the gaps which arise, instead of through the porous gas inlet brick, and thus either leave the reaction vessel, or penetrate into the interior of the reaction vessel but not in the form of the desired fine bubbles. Hence there are losses of gas, which, with the rapidly increasing use of rare gases for treatment of melt, can attain significant economic proportions. Under some circumstances also, losses of metal, or contamination of the metal through material which originates from the gaps may arise. These thermal effects not only lead to the abovementioned leaks, but also reduce the intervals between the periodic exchange of gas inlet bricks, and thus again lead to a reduction of the working life of the vessel in question.

For this reason, efforts have hitherto been concentrated on simplifying the exchange of inlet bricks and resisting the escape of gas between inlet bricks and the wall of the vessel, by surrounding the inlet brick with a metal sleeve, and seating the latter in an appropriate way into the wall of the vessel. At the present time the problems are not yet satisfactorily solved, and undesired side effects arise, which lead to disadvantages as compared with the customary building-in of the inlet bricks.

The tightness of the device cannot be significantly improved by the use of a metal sleeve, and the undesired escape of gas is not effectively eliminated: as compared with the bricks which are directly built in to the wall, an arrangement consisting of inlet brick/metal sleeve/wall has significantly greater differences in thermal expansion coefficients of the different materials. If the inlet brick is firmly fastened by screws in the metal sleeve, somewhat in accordance with the suggestions of U.S. Pat. Nos. 2,811,346 or 2,947,527, then, on heating up of the device by the metal melt, the metal sleeve expands significantly more than the inlet brick. Thus a clearance arises between sleeve and inlet brick, through which the gas can again escape in the undesired manner, or into which the liquids from the vessel can penetrate as long as the gas pressure in the gas inlet brick is not sufficient to prevent this.

Moreover the problem of convenient exchange of the inlet device cannot be regarded as solved in the state of the art: arrangements have indeed been described, in which the metal sleeve is fastened to the outer face of the wall of the vessel by means of screws (U.S. Pat. No. 2,871,008 FIG. 5). But this arrangement takes no account of the fact that, by the thermal expansion of the metal sleeve along its longitudinal axis, a displacement occurs between the cold external wall and the hot sleeve, which can lead to tensions and cracks if there is a firm connection between the pieces.

Moreover, the arrangement described indeed provides for removal of the metal sleeve from the wall of the vessel, subject to the limitations which have been discussed but does not ensure a rapid removal of the inlet brick from the metal sleeve. Even with the device mentioned, the firm connection between brick and sleeve exhibits the described drawbacks with regard to the tightness of the system at higher temperature.

The objective underlying the present invention is to provide devices for introduction of gases into vessels, which avoid the mentioned disadvantages of the state of the art, that is to say ensure tightness betweeen metal sleeve and inlet brick despite thermal effects, and easy exchangeability both of the metal sleeve in the wall and of the inlet brick in the metal sleeve.

The objective is solved in that, in a vessel according to the invention, the gas inlet device comprises a metal sleeve fastened to the outer face of the wall of the vessel in an adjustable and easily exchangeable manner by a combination of screws and spring washers, and a gas-permeable body of fire-resistant material which is mounted adjustably and exchangeably in the metal sleeve under spring pressure.

Preferably, tightness between the metal sleeve and the inlet brick is achieved, despite thermal effects upon heating up of the vessel, in that the inlet brick is pressed, by a plurality of columns of dished srings, against a portion of the metal sleeve which faces away from the interior of the vessel. Easy exchangeability of the inlet brick is achieved through the fact that the columns of dished springs rest upon an intermediate base, which in turn is secured by a circlip, fitting in an annular groove in the internal surface of the metal sleeve.

The accompanying drawings show two examples of vessels and devices which embody the invention, and also some possible modifications. In these drawings.

Figure 1:
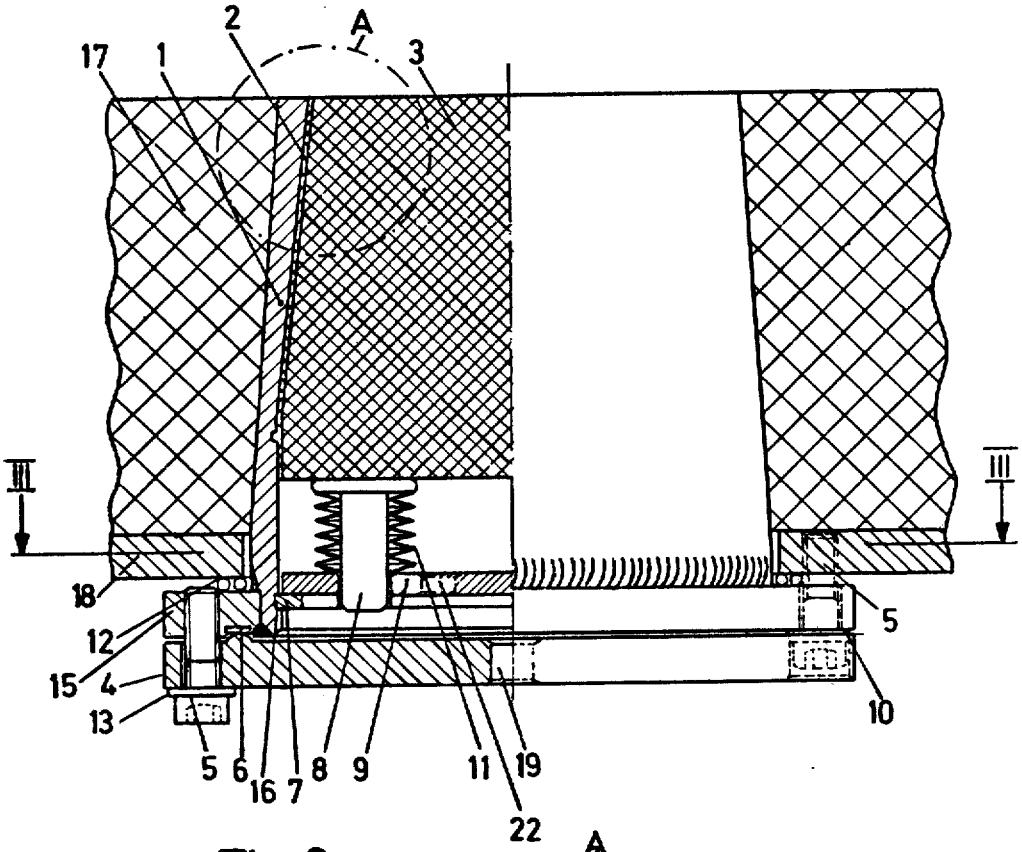
FIG. 1 shows a first gas inlet device in longitudinal section, including a gas-permeable body formed mainly as a frustum of a cone.
Figure 4:
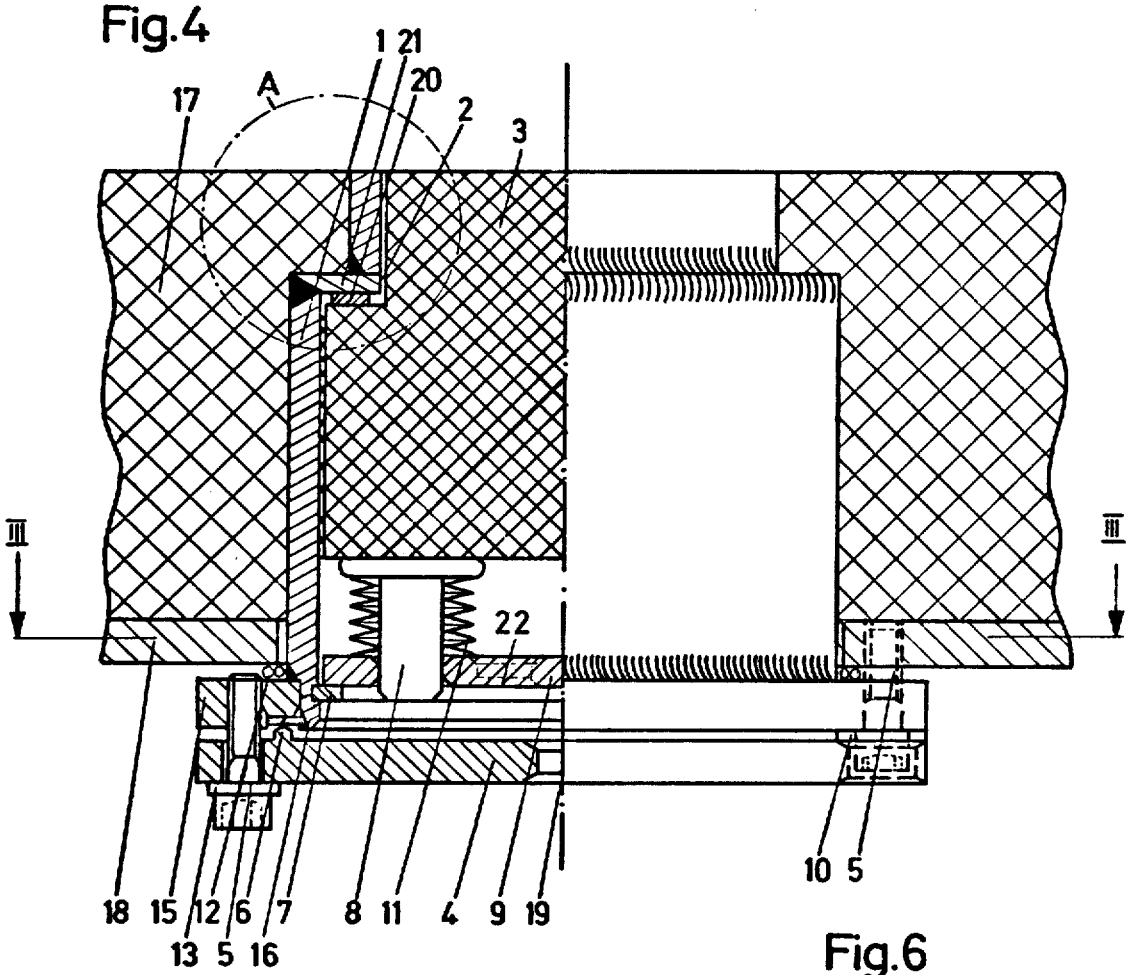
FIG. 4 shows a second gas inlet device in longitudinal section, including a gas-permeable body formed as two cylinders.

The vessels shown in FIGS. 1 and 4 have an outer wall 18 of metal and an inner wall 17 of fire-resistant material. There are aligned openings in the outer and inner wall to receive a gas inlet device. The devices shown in FIG. 1 and FIG. 4 consist substantially of a metal sleeve 1, a gas inlet brick 3 of gas-permeable fire-resistant material, and a metal lid 4 on the outer side of the device. The gas to be introduced is led through a bore 19 through the lid 4, arrives in an ante-chamber, and from there flows into the gas inlet brick 3, where it is finely divided. The gas leaves the inlet brick 3 in the form of fine bubbles through the entire end surface of the brick facing into the interior of the vessel.

The metal sleeve 1 fits in the corresponding opening in the inner wall 17 of the vessel and is fastened to the metal outer wall 18 of the vessel by a plurality of screws 5. To compensate for the thermal effects to be expected on heating up of the vessel, and the resulting relative displacement between the sleeve and the outer wall 18, the screws 5 are seated on spring washers 10. By this means, on the one hand one ensures that the gas to be introduced cannot escape through possible leaks in the material of the wall, and on the other hand one provides easy exchangeability of the entire device.

Figure 5:
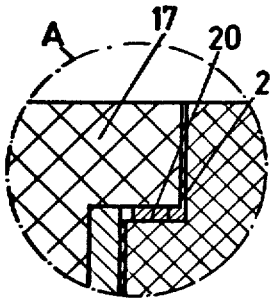
FIGS. 5 and 6 show modified details A in the gas inlet device according to FIG. 4.
Figure 6:
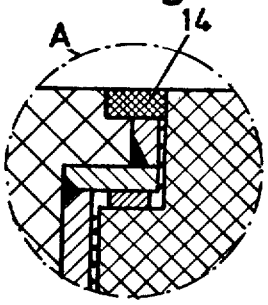

The sleeve 1 has either a conically tapering portion with an adjoining internally cylindrical portion at its outer end (FIG. 1), or it consists of two hollow cylindrical portion of different diameter, which are permanently connected together by an annular disc 21 of metal (FIGS. 4 and 6). Alternatively to the latter, one can omit the hollow cylindrical portion of smaller diameter, and terminate the sleeve 1 inwardly at a corresponding shoulder in the inner wall 17 (FIG. 5).

In all constructions, the sleeve 1 has, on its internal face approximately in the plane of the outer wall 18, an annular groove 16 for anchorage of a circlip 7. At its outer end, the metal sleeve 1 is welded onto an annular flange 15, which has a plurality of holes for reception of the screws 5, with which the metal sleeve is exchangeably fastened to the outer wall 18. Between the annular flange 15 and the outer wall 18, an insulation 12 of asbestos cord can be inserted. If the metal sleeve is made according to FIG. 1 with a conically tapering portion, then, for manufacturing reasons, it is advisable to provide a further annular groove in the internal surface of the sleeve at the transition between the conical and the cylindrical portions.

FIGS. 1 and 4 show sleeves which are built of several pieces welded together. Alternatively the entire metal sleeve may be cast in one piece from a suitable material.

With all constructions of the metal sleeve, a modification consists in not carrying the latter through to the inner face of the vessel, but to let it terminate against a ring 14 (FIGS. 2 and 6) of finely-ground concrete which is set in the inner wall 17 of the vessel and overlaps the opening in the inner wall. Thus in some circumstances a direct seal is provided between the inner wall 17 and the gas inlet brick 3, and contact between the metal of the sleeve 1 and the contents of the vessel, sometimes undesired, can be avoided.

The gas inlet brick 3 consists of gas-permeable fire-resistant material, and corresponds in its shape to the interior of the metal sleeve 1. Thus the gas inlet brick 3 may be formed as a frustion of a cone, which has a short cylindrical portion it its end of larger cross section (FIG. 1) or it may be formed of two cylindrical portions of different cross section (FIGS. 4 and 6). Between the latter and the inlet brick, a layer 2 of fibres of aluminium silicate or similar material can be used for sealing and thermal insulation.

This gas inlet brick 3 is mounted in the following way in the metal sleeve. The gas inlet brick 3 is placed loosely in the sleeve 1. Then a predetermined number of dished spring columns 8, 11 is prepared, each consisting of individual dished washers 11 alternately arranged in series on a central pin 8, and these pins are inserted in openings provided for them in an intermediate base 9 in the form of a metal disc. This base 9 is then pressed upwards until it is at the level of the annular groove 16, and at this level is locked by fitting a circlip 7 into the annular groove.

The easy exchangeability of the inlet brick in the metal sleeve arises from the simple installation and the location by means of a circlip and an annular groove. As compared with the fixed screw connections in the state of the art (such as U.S. Pat. Nos. 2,811,346 and 2,947,527) this constitutes a significant simplification of assembly.

The sequence of the steps in assembly of the sleeve 1 and gas inlet brick 3 into the wall of the vessel is optional. In particular, the gas inlet brick 3 can be exchanged while leaving the metal sleeve mounted in the wall of the vessel.

The properties required in the dished spring columns 8, 11 can be calculated according to the requirements, and the columns can be exchanged in the case of changing operating problems or ageing of the device. Moreover the weight of the inlet brick and its extent along the main axis of the cylinder (cone) can be altered for different operational requirements, e.g. to produce different bubble sizes, without the entire inlet device having to be changed. Simple variation of individual dished spring elements suffices, in order to re-establish the seal. In continuous operation in the treatment of aluminium melts at about 700° to 900° C in a filter housing of concrete, it has appeared advantageous to use spring columns made of identical dished washers arranged alternately in series. However, for other operational needs, pairs of dished washers of differing thickness could be arranged in series, which would result in a progressive operation characteristic of the columns.

Figure 2:
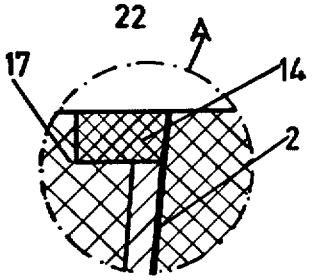
FIG. 2 shows a modified detail A in the gas inlet device according to FIG. 1.
Figure 3:
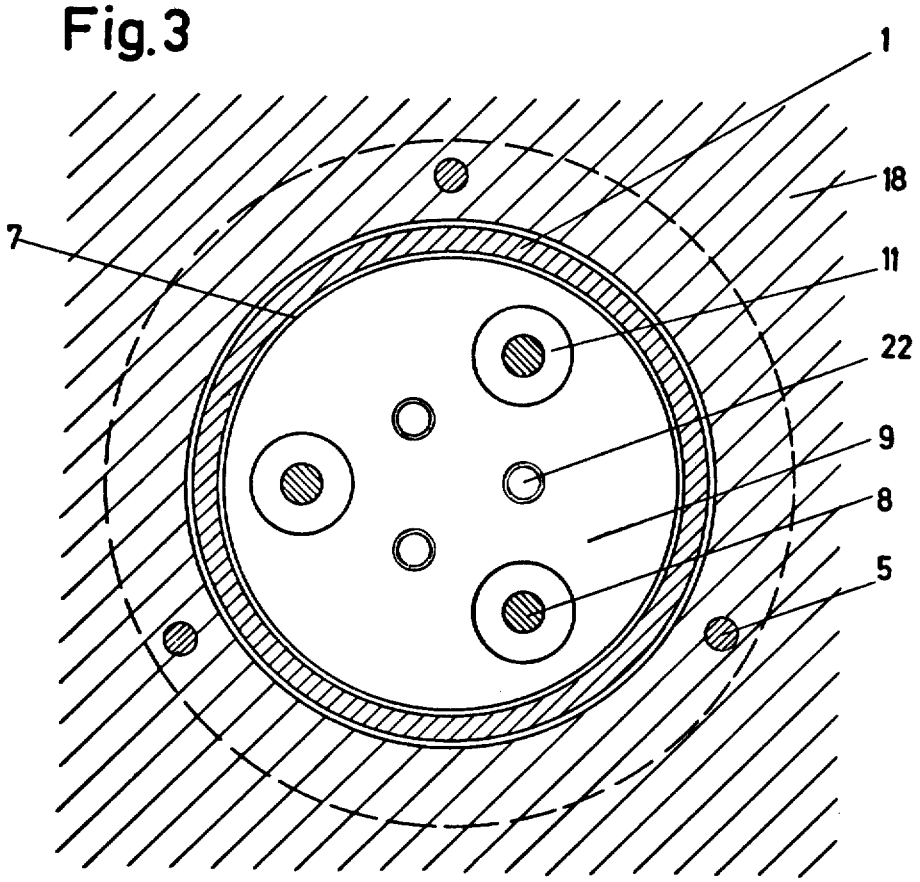
FIG. 3 is a cross section on the line III—III in FIGS. 1 and 4.

With the conical construction according to FIGS. 1 and 2, heating up of the vessel produces greater thermal expansion, in radial directions, of the sleeve than of the gas inlet brick. Thereupon the gas inlet brick 3 is automatically shifted more deeply into the sleeve by the spring pressure, and thus, on heating up of the vessel, tight sealing is continuously achieved. The dished spring columns should be selected having regard at the same time to the weight of the inlet brick, the angle of the conical surface to the longitudinal axis, and the expected thermal expansion of the sleeve.

With each of the cylindrical constructions according to FIG. 4 and FIG. 6, an annular seal 20 of metal or another suitable material is incorporated between the sleeve 1 and the inlet brick 3 at the transition region 21 between the part with the larger diameter and the part with the smaller diameter. In this construction also, during heating up of the vessel, tight sealing is continuously achieved between the portion 21 of the sleeve and the inlet brick, because the greater thermal expansion of the sleeve in its longitudinal direction is balanced by the pressure of the dished spring columns 8, 11. In the cylindrical construction, the dished spring columns should be selected having regard to the weight of the inlet brick, the expected thermal expansion of the sleeve, and the distance between the annular groove and the seal 20.

In FIG. 5 there is a similar seal 20 between the brick 3 and the shoulder in the inner wall 17.

The circular metal lid 4 serves for closing the device on the outside of the vessel. It has a plurality of bores for reception of screws 5, a central bore 19 for introduction of the gas inlet pipe, as well as an annular ridge, which fits in a recess 6 in the annular flange 15. During assembly of this metal lid 4, an annular seal of metal or another suitable material is pressed between the ridge and the recess. Then the screws 5 are secured onto spring washers 13.

The gas arrives under appropriate pressure through the central bore 19, into an ante-room constituted by the lid 4 and the metal sleeve 1, then flows through bores 22 in the intermediate base 9 into a further ante-room constituted by the intermediate base 9 and the brick 3, and from there into the gas-permeable inlet brick 3. By the fine pores of the latter, the gas is finely divided and emerges in bubble form over the entire end surface of the gas inlet brick into the liquid contained in the vessel.

In an operational example, argon was introduced into an aluminium melt by a device according to FIG. 1. The gas pressure in the ante-chamber upstream of the inlet brick itself was 1 to 3 atmospheres, the rate of flow was 3.3 $Nm^3/h.m^2$ in continuous operation, and the temperature of the aluminium melt was 710° C. The inlet brick consisted of zirconium silicate, the sleeve of steel, and the inner wall of the vessel of fire-resistant cement. As compared with an inlet device with a built-in inlet brick, the gas lost with equal quality of the purified metal was reduced by 50% in continuous operation. After a single assembly of the device, it appeared to be practically free of maintenance, while with built-in inlet bricks frequent leakages had to be repaired. While built-in bricks had to be exchanged after three months in continuous operation, the inlet bricks in the device embodying the invention were entirely satisfactory even after 6 months.

We claim:

1. A vessel which, when in use, is subject to thermal stress, and which includes a device for introduction of gas through the wall of the vessel, the vessel including an enclosing wall through which there is an opening, and the device comprising a metal sleeve fitting in the opening, means comprising screws and spring washers anchoring the sleeve to the outer face of the wall in an adjustable and easily exchangeable manner, a gas-permeable body of fire-resistant material fitting in the sleeve, and means exerting spring pressure on the body and thereby locating the body in the sleeve in an adjustable and easily exchangeable manner, in which the means exerting spring pressure is at least one dished spring column consisting of a series of pairs of oppositely oriented dished spring washers, in which the dished spring columns abut a metal disc with openings, which is retained by means of a circlip in an annular groove in the internal surface of the metal sleeve.

2. A vessel which, when in use, is subject to thermal stress, and which includes a device for introduction of gas through the wall of the vessel, the vessel including an enclosing wall through which is an opening, and the device comprising a metal sleeve fitting in the opening, means comprising screws and spring washers anchoring the sleeve to the outer face of the wall in an adjustable and easily exchangeable manner, a gas-permeable body of fire-resistant material fitting in the sleeve, and means exerting spring pressure on the body and thereby locating the body in the sleeve in an adjustable and easily exchangeable manner, in which the edge of the inner face of the wall of the vessel around the gas-permeable body is strengthened with a ring of finely-ground concrete supported by the top of the wall and bridging the gap to the external surface near the top of said body.

* * * * *